United States Patent [19]

Steiner

[11] Patent Number: 4,484,603

[45] Date of Patent: Nov. 27, 1984

[54] SERIAL SHED WEAVING MACHINE WITH A WEAVING ROTOR

[75] Inventor: Alois Steiner, Rieden, Switzerland

[73] Assignee: Sulzer-Ruti Machinery Works Ltd., Ruti, Switzerland

[21] Appl. No.: 463,022

[22] Filed: Feb. 1, 1983

[30] Foreign Application Priority Data

Feb. 19, 1982 [CH] Switzerland ..... 1039/82

[51] Int. Cl.[3] ..... D03D 47/30; D03D 41/00

[52] U.S. Cl. ..... 139/11; 139/135

[58] Field of Search ..... 139/11 R, 11 A, 435, 139/28, 439

[56] References Cited

U.S. PATENT DOCUMENTS 3,796,236 3/1974 Kamp ..... 139/439

4,425,946 1/1984 McGinley ..... 139/11 A

FOREIGN PATENT DOCUMENTS 2072719 10/1981 United Kingdom ..... 139/11 A

*Primary Examiner*—Henry S. Jaudon

*Attorney, Agent, or Firm*—Burns, Doane, Swecker & Mathis

[57] ABSTRACT

The present invention relates to a serial shed weaving machine with a weaving rotor. Guide channels for weft threads transported by a flowing fluid are mounted on the weaving rotor. The guide channels are formed from a plurality of elongated, tube-like channel elements having a closable weft thread exit gap. The channel elements have complementary end configurations such that they can be moved together to form a closed guide channel. The channel elements are movable back and forth in the weft insertion direction. When the channels are moved in a first direction, the closed guide channel is opened and gaps are formed between the channel elements and each channel element is moved out of its associated part of the warp shed. When the channel elements are moved in a second direction, each channel element is moved back into its associated part of the warp shed and the guide channel is closed. The total excursion of each channel element in each direction is at least as great as the length of the element. Since the motion of the channel elements is exclusively back and forth in the weft insertion direction, the drive for such motion is relatively simple. Further, since the channel elements are each several centimeters long, the number of possible leak locations is sharply reduced over the prior art such that the weft threads may be inserted by suction air pressure.

18 Claims, 4 Drawing Figures

SERIAL SHED WEAVING MACHINE WITH A WEAVING ROTOR

BACKGROUND AND SUMMARY OF THE PRESENT INVENTION

The present invention relates to a serial shed weaving machine with a weaving rotor. The weaving rotor includes combs having shed retaining elements for the warp threads. The combs form open warp sheds which travel in the warp direction. The weaving rotor also has guide channels comprised of a plurality of channel elements for guiding the weft the threads which are transported by a flowing fluid. Each of the channel elements has an exit gap or slot in a wall to permit exit of the weft thread and is mounted so as to be movable with respect to the other channel elements. The weft exit slot is adapted to be closed in response to movement of the channel elements. Each channel element has its forward and rearward ends (with respect to the weft insertion direction) configured such that when the channel elements of a given guide channel are positioned for weft insertion, the channel elements form a continuous closed guide channel.

Such a serial shed weaving machine is described in German Offenlegungsschrift No. 31 11 780 (corresponding to U.S. patent application Ser. No. 06/241,934). In this known weaving machine, each guide channel is comprised of two combs comprised of dents which may be moved into and out of the midst of the warp threads with the dents forming the channel elements. The dents are relatively thin, and their end faces (i.e., their forward and rearward faces in the weft insertion direction) have complementary wedge surfaces which facilitate the movement of the combs into and out of one another. The dents of each comb are attached to at least one bar which extends over the width of the weaving machine. The bars are operatively connected to drive levers which are controlled via cams mounted on the machine frame to cause movement of the combs into and out of one another.

This known serial shed weaving machine is intended to enable weft insertion by aspirated air, i.e., suction air pressure, rather than blown air. The use of suction air provides not only substantial energy savings but also much more even (non-turbulent) passage of the weft thread and better overall control of the weft insertion. It has been found, however, that due to the thinness of the dents there are a large number of potential leakage locations which interfere with the aim of satisfactory weft insertion by aspirated air. In addition, the drive system for the combs including bars, drive levers, and cams employs a large number of mechanically manipulated and loaded parts which are necessarily subject to undesirable wear.

It is an object of the present invention to improve and refine the known serial shed weaving machine in such a way that the weft threads can be inserted by aspirated air. A further object of the present invention is to provide a serial shed weaving machine in which the system comprising the guide channels and the operating and control arrangement for the channel elements is as simple as possible both structurally and from a manufacturing and systems reliability standpoint. In particular, the system is comprised of a small number of parts which are subjected to minimal mechanical load and stress.

These objects and others are achieved according to the present invention by channel elements having an elongated tubular shape. The length of the channel elements is a multiple of the thickness of one of the shed retaining elements. The elements are movable back and forth in the weft insertion direction by a drive such that when the channel elements are moved in one direction the closed guide channel is opened. At this time, gaps develop between the elements, and each channel element is moved out of the corresponding part of the warp shed. When the channel elements are moved in the other direction, each channel element is moved into the corresponding part of the warp shed and the guide channel is again closed. The total excursion of each channel element in one direction is at least equal to its length in the weft insertion direction.

The inventive use of elongated, tubular, channel-like dents for forming the guide channel instead of the formerly employed narrow, plate-like dents drastically reduces the number of potential leaks, by more than an order of magnitude, such that the weft threads may now be inserted with aspirated air, which provides the advantages mentioned. The fact that the movement of the channel elements is in the weft insertion direction makes it possible to drive and control the elements by simpler arrangements than in the prior art where movement of the dents was rotational in a plane transverse to the insertion direction.

BRIEF DESCRIPTION OF THE DRAWINGS

A preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
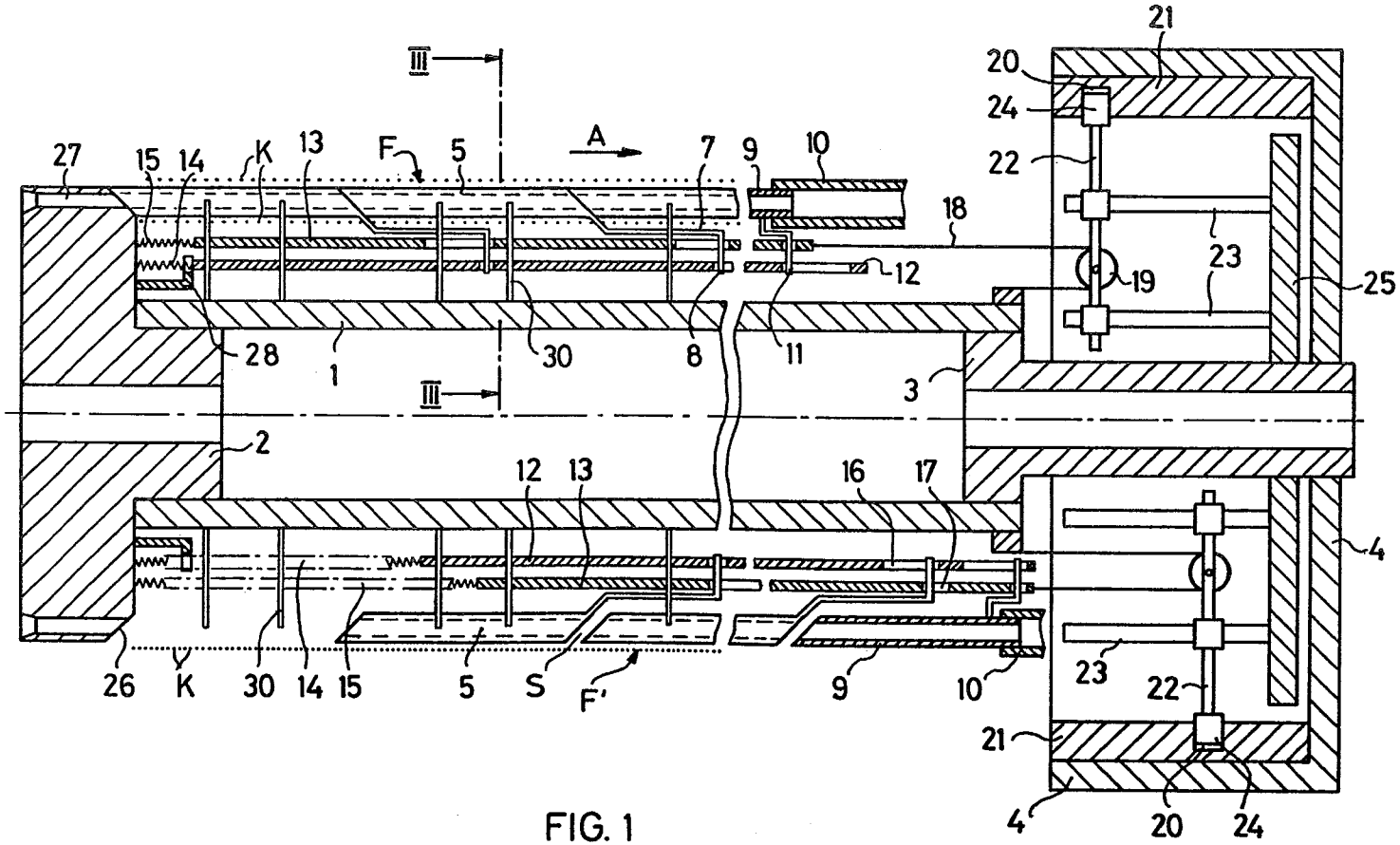
FIG. 1 is a schematic longitudinal cross-sectional view of a weaving rotor of a serial shed weaving machine.
Figure 3:
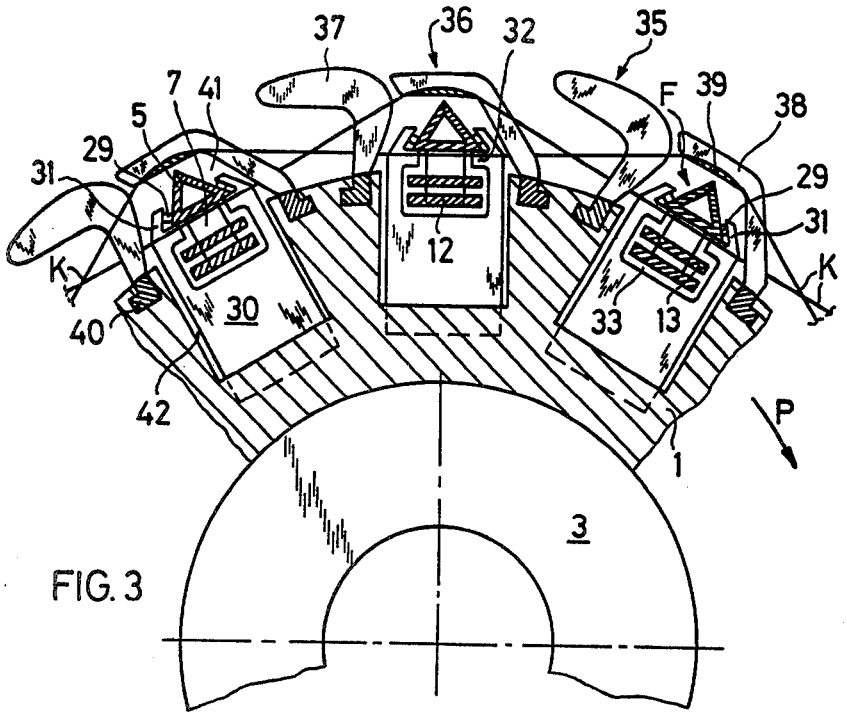
FIG. 3 is a cross-sectional view taken along the lines III—III of FIG. 1.

FIGS. 1 and 3 are, respectively, longitudinal and transverse cross-sectional views of a weaving rotor of a serial shed weaving machine. During operation the weaving rotor rotates in the direction shown by arrow P in FIG. 3. The operating details and structure of a serial shed weaving machine with a weaving rotor are described in detail in U.S. Pat. No. 4,290,458 issued Sept. 27, 1981 to Steiner which is hereby incorporated by reference. Accordingly, no further description of this operation and structure in detail will be made herein.

The weaving rotor (FIG. 1) has a hollow cylinder 1 which extends over the width of the warp. The rotor is rotatably supported on the machine at the side of the warp threads and is driven by a drive which is likewise disposed on the machine frame at the side. With reference to FIG. 1, the hollow cylinder 1 is supported on its left end face by a flange 2 and on its right end face by a hollow stub or mandrel 3. The flange 2 is rotatably mounted on the left machine wall and the hollow stub 3 is rotatably mounted in a housing 4 which is rigidly attached to the right machine wall. Weft insertion occurs in the direction of arrow A, from left to right as seen in FIG. 1.

On the outer surface of the weaving rotor, guide combs for the warp threads and set-up combs similar to reeds are mounted alternately in the longitudinal direction of the hollow cylinder 1 (and thus in the weft insertion direction A). The outer surface also includes guide channels F for the weft threads. Over the entire surface of the weaving rotor there are 12 to 14 of the guide combs and of the set-up combs and about the same number of guide channels F (FIG. 3).

The guide channels will be described with reference to FIGS. 1 and 2. Each guide channel F is comprised of a number of longitudinally oriented tubular channel elements 5 disposed in a longitudinal sequence along the hollow cylinder 1. One such channel element is shown in a perspective view in FIG. 2. The channel elements 5 have a triangular cross-section, and have a longitudinal gap 6 at their upper longitudinal edge between the two side faces. Their forward and rearward end faces are inclined at a uniform angle. The bevel on the forward end face (in the insertion direction A) of each channel element 5 merges into a tongue section 7 which is bent away from the bottom face of the channel element 5 at the same angle as the forward end face. Further forward, the tongue section runs horizontally from the inclined segment, and then at its free end the tongue section 7 is bent back vertically, i.e., toward the axis of the hollow cylinder 1. This bent-back end 8 of the tongue section 7 acts as a dog for moving the channel element 5.

The weft threads are inserted in the guide channels F formed from the channel elements, by the action of a flowing fluid, in particular air (aspirated air or suction air pressure, for example). For this purpose a connecting element 9 is mounted adjacent to the forwardmost, i.e., furthest downstream, channel element 5 in each guide channel F for connection to tubing 10 or a flexible conduit leading to a suction device (not shown). The connecting elements 9 are disposed outside of the warp threads K, and have the same cross-section and the same end-face inclination as the adjacent channel elements 5. The connecting elements 9 also have dog projections 11 which extend down toward the axis of the hollow cylinder 1. The precise configuration of the projections 11 is arbitrary within wide limits. The connecting elements 9 lack the longitudinal gap 6 which the channel elements 5 have since their outer surface is closed.

For each weft insertion, a weft thread is sucked through the channel elements 5 of each of the guide channels F in the insertion direction A. During this process the respective warp sheds open, with the warp threads K lying over and under the respective guide channels (see the top guide channel F in FIG. 1). After the conclusion of each weft insertion the respective weft thread leaves its guide channel F via the longitudinal gap 6 in the direction away from the axis of the hollow cylinder 1. Then the warp must be closed, which is accomplished by displacing the channel elements 5 by varying amounts in the insertion direction A (as seen in the bottom guide channel F′ in FIG. 1). As soon as the new warp shed is open, the channel elements 5 are shifted back in the direction opposite to the weft insertion direction A, and the guide channel F is closed again.

The shifting of the channel elements 5 back and forth in the insertion direction A is accomplished by a drive mechanism which is disposed between the hollow cylinder 1 and the channel elements 5 and which act on the dogs 8 and 11 of the channel elements 5 and the connecting elements 9, respectively. As shown in the Figures, a drive mechanism is provided for each guide channel F by two bands or flat bars 12 and 13 disposed one above the other. On the weft insertion side these bars are attached to the flange 2 via tension springs 14 and 15, respectively. One of the bands (in the illustrated embodiment the outer band 13) is attached on its weft exit end to the drive mechanism.

The bands 12 and 13 have openings 16 and 17, respectively, in which the dogs 8 and 11, respectively, are engaged. In this way, when the bands 12 and 13 move back and forth in the insertion direction A the channel elements 5 and the connecting elements 9 execute a similar motion.

The drive mechanism of the bands 12 and 13 according to FIG. 1 comprises a cable 18, one end of which is attached to the outer band 13. The other end of the cable 18 is attached to the hollow cylinder 1. Movement of a pulley 19 around which cable 18 is passed is controlled by a cam 20 in the form of a curved slot. The cam 20 is milled into a bushing 21 which is rigidly attached to the housing 4. Thus, the cam 20 is rigidly attached to the machine frame. The pulley 19 is mounted on a rod 22 which is mounted in turn on two bearing rods 23 so as to be slidable back and forth in the insertion direction A. The rod 22 has a pickup cylinder 24 on one end, which cylinder engages the cam 20. The bearing rods 23 are attached to a rotatable disc 25 which is rigidly attached to the hollow stub 3 to rotate with respect to the housing 4 and the cam 20.

When the hollow cylinder 1 rotates, and the weaving rotor with the guide channels F thus rotates along with the cylinder, the guide rods 22 and the pickup cylinders 24 follow the cam slots 20. In this way, the pulleys 19 are shifted between the end positions shown on the top and on the bottom of FIG. 1. Each outer band 13 and each channel element 5 executes a translational movement twice that of the corresponding pulley 19 due to the block and tackle action of the cable 18 and the pulley 19. Since the dogs 8 and 11 of the channel elements 5 and the connecting elements 9, respectively, extend through the respective openings 16 and 17 of both bands 12 and 13, the motion of the outer bands 13 is transmitted to the respective inner bands 12 via the dogs 8 and 11.

The configuration of the cam slot 20 and the positions and sizes of the openings 16 and 17 in bands 12 and 13 are arranged in a predetermined manner. Starting with the position of the channel elements 5 shown on the top in FIG. 1 wherein the channel elements form a closed guide channel F, the channel elements are moved in the following sequence. As soon as weft insertion in a given guide channel F is completed, the pulley 19 is moved in the insertion direction A whereby the outer band 13 is moved in the same direction. In this way, in a first stage a gap S is produced between all the channel elements 5 so that the warp threads K can pass through from a lower to an upper shed position. The size of these gaps S, which in practice is about 1–2 mm, is limited by the inner band 12. The inner band 12 also maintains the gaps S over the course of further shifting of the channel elements 5.

It should be noted that the flange 2 has a matching stop surface 26 for each guide channel F. Each such surface has a bore hole 27 through which the weft thread is sucked into the guide channel F. The weft thread is supplied up to or into the bore hole 27 by a suitable supply means (not shown).

In a second stage, the pulley 19 is moved further in the weft insertion direction A, shifting all the channel elements 5 in the same direction until the point that the expanded guide channel F has moved a distance away from the stop surface 26 equal to the length of a channel element 5 plus one gap length S. In this position (F' at the bottom of FIG. 1), the gaps S have been maintained. As a consequence of the configuration of the tongues 7, this shifting of the channel elements 5 causes the warp threads K in the lower shed position to move into the upper shed position, over the path opened up through the gaps S between the channel elements 5. At the bottom position in FIG. 1, all the warp threads K in the segment of the warp not occupied by channel elements 5, namely those in the segment adjacent to the stop surface 26, are shown also in the upper shed position. This is not necessarily the situation, since the threads K in this free segment will likely take a position intermediate between the upper and lower shed position, as determined by the shed geometry. When the weaving rotor is rotated further, the channel elements 5 will be rotated out of the plane of the warp threads, and all the warp threads K will be free to assume the closed shed position. In this position, setting up, i.e., beating up, of the weft thread is carried out.

The weaving rotor then executes a relatively large rotational excursion with the guide channel F' open until this open guide channel F' again comes upon warp threads K, which threads meanwhile have undergone a shed inversion motion. In the free segment opened up by the movement of the channel element 5 which is on the weft entry side, namely the space between the stop surface 26 and the expanded guide channel F', the warp threads K have already returned to the upper and lower shed positions, i.e., the shed is now open. Over the remainder of the width of the warp, the warp threads of the lower shed position cannot reach that position, due to the channel elements 5 which intervene. Instead, the threads of the lower shed position press under tension against the outer edge of the channel elements 5 where the gap 6 is.

The pulley 19 is then moved in the direction opposite to the insertion direction, and in a third stage the channel elements 5 are moved against the stop surface 26 such that the gap adjacent the stop surface 26 is closed and the gaps S (which have remained open during the movement) are all that remains open. Thus, the motion in the third stage, in which springs 14 and 15 assist in the movement of the bands 12 and 13, respectively, is the opposite of the movement in the second stage.

When the individual channel elements 5 are shifted, the warp threads K intended for the lower shed position pass through the corresponding gaps S into the lower shed position, so that each channel element 5 ends up within an open warp shed segment. At the conclusion of the third stage the weft-insertionside end of the inner band 12 strikes a detent 28 mounted on the flange 2 to prevent the band from moving further toward the flange 2.

At this point, the guide channel has the same lateral position as after the first stage, i.e., the only gaps are the gaps S. The pulley 19 is now moved further in the direction opposite to the insertion direction, in a fourth stage, in which the movement is the opposite of the movement in the first stage. In the process, the gaps S are now closed and the guide channel returns to the position shown on the top of FIG. 1, where the channel is now again ready for weft insertion. The action of the spring 15 ensures that the channel elements 5 press against each other and against the stop surface 26, so that the guide channel F is airtight in the longitudinal direction and free of leaks.

The opening and closing of the weft channels F which are described here in terms of sequences of operations will be further described infra in quantitative terms, with reference to FIG. 4, where the arrangement and widths of the openings 16 and 17, and the distances of the excursions, will be discussed.

As mentioned previously, the weft is inserted by suction. This imposes the requirement that the guide channel F be sealed, i.e., leak-free, along its length including the end connections. The manner in which the guide channel F is closed in its longitudinal direction was described supra. It must also be airtight in the radial direction. In other words, the gaps 6 in the channel elements 5, which gaps are present to enable the weft thread to exit from the guide channel F, must also be closed during weft insertion. This is described in the following.

Figure 2:
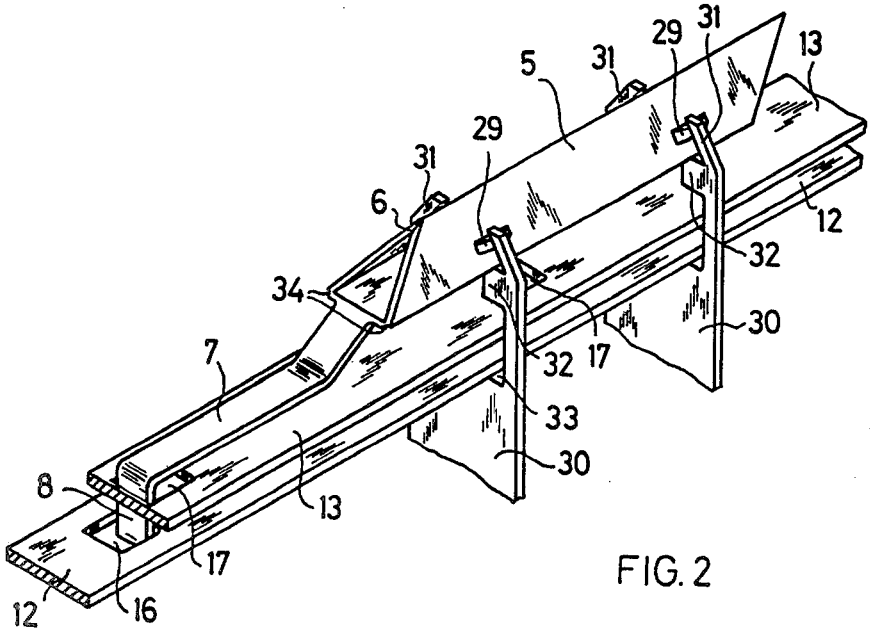
FIG. 2 is a perspective view in greater detail of a portion of FIG. 1.

With reference to FIGS. 2 and 3, each channel element 5 has two projections 29 on each of its two side faces. Shaped plates 30 are mounted on the hollow cylinder 1 (FIG. 3), which plates 30 serve to support the channel elements 5 and, by acting on the projections 29, to close the gaps 6. Each shaped plate 30 has a jaw on its end which extends outwardly away from the hollow cylinder 1. The jaw comprises an opening bounded by two side members 31 and two supports 32. The gap between the supports 32, on which supports the channel elements 5 rest, is wider than the width of the tongue 7. Adjacent to the supports 32 in the direction toward the hollow cylinder 1, there is an opening 33 for the bands 12 and 13 to pass through the shaped plate 30. Thus, the openings 33 hold and confine the bands 12 and 13, and the supports 32 support and guide the channel elements 5.

The jaw of the shaped plates 30 has a truncated triangular cross-section corresponding to the cross-sectional shape of the channel elements 5. However, the triangle of the jaw is larger, so that as soon as and, as long as, the projections 29 are moved away from direct engagement with the side members 31, the gap 6 is open. When the channel elements 5 are shifted so that the projections 29 move between the side members 32, the side surfaces of the channel elements 5 on which the projections 29 are mounted are pressed together and the gap 6 is closed. Since the shaped plates 30 are rigidly mounted to the hollow cylinder 1, the gaps 6 are opened and closed automatically as the channel elements 5 undergo the described shifting forward and backward in the weft insertion direction A.

In the open state, the gap 6 is about 1 to 2 mm wide, which is adequate for the weft thread to exit. This gap occurs automatically when the guide channel F is opened, i.e., expanded longitudinally. The warp threads K which thereby move into the upper shed position will carry the weft thread toward and through the gaps 6. This process is aided by the triangular cross-section of the channel elements 5.

The opening of the gap 6 when the projections 29 are moved out of the jaws of the shaped plates 30 is automatic and unaided. To accomplish this automatic opening, the channel elements 5 are manufactured such that in the rest state they have a longitudinal gap 6 of the prescribed width. The channel elements 5 are molded in a single piece with the tongues 7 and dogs 8, of a suitable plastic material, e.g., a polyamide such as nylon 6. In order to minimize the amount of force needed to close the gap 6, the walls of the channel elements 5 have thinned regions at the two edges between the bottom surface and the side surfaces (so-called "film hinges") in the form of the grooves 34.

FIG. 3 is a cross-sectional view of the weaving rotor shown schematically in FIG. 1. With particular reference to FIG. 3, the configurations of the set-up combs 35 and the guide combs 36, and the arrangement of these combs with the guide channels F on the outer surface of the hollow cylinder 1 is illustrated.

The set-up combs 35, i.e., reeds, are comprised of set-up dents 37 disposed equidistant along the hollow cylinder 1 for setting up the inserted weft threads. The guide combs 36 are comprised of guide dents 38 also disposed in lines along the hollow cylinder 1. Alternating in the spaces between the guide dents, shed retaining elements 39 are mounted for holding the warp threads K in the upper and lower warp shed positions.

The shed retaining elements 39 for the upper shed position are in the form of projections on one side of the guide dents 38. Since the warp threads K for the upper shed position lie on the shed retaining elements 39 under tension, shed retaining elements for the lower shed position are not required. It is sufficient if an appropriate amount of free space is available above the surface of the hollow cylinder 1 for the threads of the lower shed position to pass and be held by virtue of the tension on them. Suitable spacers 40 are provided between the dents of each set-up comb 35, as well as between the dents of each guide comb 36.

The shed retaining elements 39 thus serve to position the warp threads K in the lower as well as the upper shed positions over the extent of the angle over which the warp threads pass around the weaving rotor. The thus formed warp sheds extend one ahead of the other up to the fell of the fabric. The individual weft threads are inserted into the corresponding sheds in steps at spaced distance intervals at the time when the sheds are open.

The parts of the set-up dents 37 and the guide dents 38 which extend out from the surface of the hollow cylinder 1 have a bent-finger shape, with the bend being in the direction opposite to the rotational direction P of the weaving rotor. As seen in FIG. 3, the inner edges of the guide dents 38 and the leading external edges of the set-up dents 37 (in the rotation direction P) define a channel-like space 41 which extends over the width of the warp. The guide channels F are disposed in respective spaces 41.

The outer part of the hollow cylinder 1 (FIG. 3) has L-shaped grooves for holding the set-up combs 35 and the guide combs 36. Between each associated pair of combs and radially below the channel-like space 41 there is an open channel 42 which extends over the width of the warp and in which the shaped plates 30 and the bands 12 and 13 are disposed. The open jaws of the shaped plates 30 which support the channel elements 5 extend radially outwardly into the corresponding channel-like spaces 41.

The thickness of the set-up dents 37 and the guide dents 38 which make up the set-up and guide combs 35 and 36 are approximately the same as the thickness of ordinary reed dents. The intermediate open spaces for the lower shed position of the warp threads are also about the thickness of a reed dent. The thickness of the shed retaining elements 39 for the upper shed position of the warp threads is a multiple of this thickness. Generally when the desired product is changed the set-up combs 35 and the guide combs 36 are changed. The type of product produced and the types of warp and weft materials used do not have a bearing on the parameters of the channel elements 5 (and thus the guide channels F). Therefore there is no need to change the channel elements 5, the shaped plates 30, the bands 12 and 13, or the drive mechanism for the bands (FIG. 1) when changing the desired product.

Figure 4:
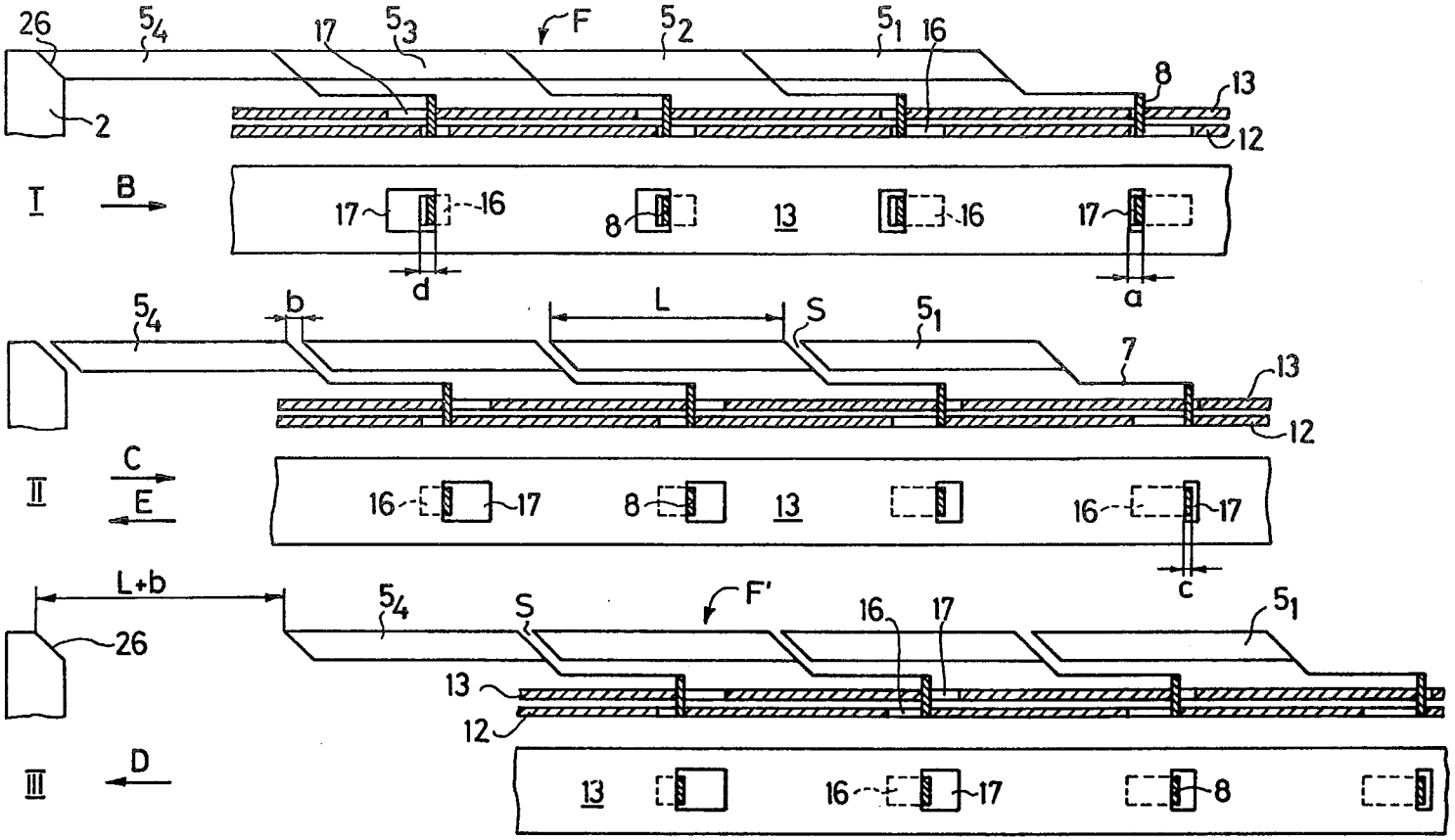
FIG. 4 is sequential schematic views for explaining the operation of the present invention.

FIG. 4 is a schematic representation of the opening and closing of a guide channel F in terms of three states: I, II and III. The stop surface 26 of the flange 2, and the positions of the channel elements 5 and the bands 12 and 13 are shown for each of these states. Beneath the cross-sectional views of the bands 12 and 13, corresponding schematic plan views of these bands are shown, giving the positions and sizes of the openings 16 and 17 as well as the positions of the dogs 8 in these openings. For the sake of simplicity, only four channel elements $5_1$ to $5_4$ are shown.

In state I, the guide channel F is closed. To reach state II, in which the gaps S are open, the bands 12 and 13 are moved in the direction of arrow B (the first stage in the discussion supra). Additional movement of the bands in the direction of arrow C yields state III (second stage in the discussion supra), in which the guide channel is completely open (i.e., with all the gaps S open) and the gap between the stop surface 26 and the closest channel element $5_4$ is equal to the length of a channel element plus the width of a gap S. In the third stage (see discussion supra) the guide channel is moved back in the direction of arrow D, to reestablish state II, and in the fourth stage the guide channel is moved back in the direction of arrow E to reestablish state I.

The length of each channel element 5, which in practice will be about 100 mm, is designated L. The width of a gap S is designated b. When the gaps S are opened in the first stage, the first channel element $5_4$ must be moved away from stop surface 26 by the distance b in the direction of arrow B. The second channel element $5_3$ must be moved a distance 2b with respect to stop surface 26; the third element, a distance 3b; and so forth. In this way, the guide channel F is opened from its forward end, i.e., from the weft exit end. The movement proceeds as follows: first, the forwardmost channel element $5_1$ is moved in the direction of the arrow B by just the distance b, at which point the next channel element $5_2$ begins to move, while the forwardmost element $5_1$ is carried along farther. At the conclusion of the first stage the channel element $5_4$ which is located at the stop surface 26 is moved along by the distance b. The connecting element 9 (FIG. 1) is not engaging any warp threads, and therefore there is no need to produce a gap between it and the forwardmost channel element $5_1$. Accordingly, the connecting element 9 may have its dog 11 rigidly connected to the band 13.

The dog 8 of the forwardmost channel element $5_1$ may also be rigidly connected to the outer band 13. In the illustrated embodiment, this dog 8 extends into an opening 17 having a width a slightly greater than the thickness c of the dog 8. The width of the opening 17 for the dog 8 of the next channel element $5_2$ behind the forwardmost element $5_1$ is (a+b). Similarly, the width of the opening 17 for the dog 8 of the n-th channel element is [a+(n−1)b]. The spacing between the forward edges (with respect to arrow B) of adjacent openings 17 is L.

The inner band 12 serves to maintain the gaps S during the second and third stages. This band is not moved directly but through the intermediary of the dogs 8 which are moved by the outer band 13 and extend into the openings 16 of the inner band 12. Therefore, the relationship between the individual openings 16 is the reverse of that between the corresponding openings 17. Thus, the opening 16 associated with the forwardmost channel element $5_1$ is the widest opening in the band 12, and the rearmost opening 16 is the narrowest.

In state I (FIG. 4), the distance between the rear edge of the openings 16 and the forward side of the associated dog 8 is the same for all openings 16, namely d. The distance d is greater than the thickness c of the dogs. The purpose of this is to leave room so that when state I is reached after the fourth stage, with the gaps S reclosed, the spring 15 (FIG. 1) will pull all the channel elements 5 to the stop point provided by stop surface 26. In this way, the sealing of the guide channel F is ensured. Preferably, the cable 18 (FIG. 1) is also attached to band 13 with play, to ensure the sealability of the guide channel F under the influence of the action of the spring 15.

The overall width of the rearmost opening 16 (associated with the rearmost channel element $5_4$) is d+b; that of the next opening 16 is d+2b; and that of the opening 16 associated with the n-th channel element is d+nb. In comparing the widths of the openings 16 and 17 it should be noted that in the formula for the openings 16, n=1 for the channel element 5 located at or adjacent to the stop surface 26, while in the formula for the openings 17, n=1 for the channel element 5 located at or adjacent to the connecting element 9 (FIG. 1).

After the completion of the first stage, all the dogs 8 are at the forward edges of the openings 16, and thus at the beginning of the second stage the inner band 12 is in the process of being moved in the direction of arrow C along with the outer band 13. This movement of the band 12 is against the force of the spring 14 (FIG. 1). As is seen from the diagrams for the states II and III (FIG. 4), the dogs at this point are also positioned against the rear edges of the openings 17, and thus are simultaneously subjected to the force of these rear edges and the forward edges of the openings 16. This ensures that the gaps S will remain open in the second and third stages and will re-close only after the rear end of inner band 12 hits the detent 28 (FIG. 1), in the fourth stage.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A serial shed weaving machine, comprising a weaving rotor having shed retaining means for disposing the warp threads in the form of traveling open warp sheds which travel in the warp direction, said weaving rotor having guide channels for guiding the weft threads transported by a flowing fluid through said open warp sheds, each of said guide channels including a plurality of axially elongated tubular channel elements, each of the channel elements having a weft exit passage therethrough and being movably mounted with respect to the other channel elements, each of said channel elements having an axial length which is substantially greater than the axial length of the shed retaining means, each of the channel elements being configured at its forward and rearward ends with respect to the weft insertion direction such that when the channel elements of a respective guide channel are positioned for weft insertion the elements form a continuous closed guide channel, and means for moving the channel elements back and forth in the weft insertion direction such that when the channel elements are moved in a first direction the closed guide channel is opened to develop gaps between adjacent channel elements and each channel element is moved out of its corresponding part of the warp shed, and when the channel elements are moved in a second direction each channel element is moved into its corresponding part of the warp shed and the guide channel is closed, the total excursion of each channel element in one direction being at least equal to its length in the weft insertion direction.

2. The serial shed weaving machine according to claim 1, wherein the channel elements have a cross-section which narrows in a direction away from an axis of the weaving rotor, the weft exit passage being located in a portion of each channel element furthest from said axis.

3. The serial shed weaving machine according to claim 1, wherein the length of each channel element is greater than 10 mm and is preferably about 100 mm.

4. The serial shed weaving machine according to claim 1, wherein the length of each channel element is approximately 100 mm.

5. The serial shed weaving machine according to claim 1, wherein the length of each channel element is an integral multiple of the axial length of one of the shed retaining means.

6. A serial shed weaving machine, comprising a weaving rotor having shed retaining means for disposing the warp threads in the form of traveling open warp sheds which travel in the warp direction, said weaving rotor having guide channels for guiding the weft threads transported by a flowing fluid through said open warp sheds, each of said guide channels including a plurality of axially elongated tubular channel elements, each of the channel elements having a weft exit passage therethrough and being movably mounted with respect to the other channel elements, each of the channel elements being configured at its forward and rearward ends with respect to the weft insertion direction such that when the channel elements of a respective guide channel are positioned for weft insertion the elements form a continuous closed guide channel, and means for moving the channel elements back and forth in the weft insertion direction such that when the channel elements are moved in a first direction the closed guide channel is opened to develop gaps between adjacent channel elements and each channel element is moved out of its corresponding part of the warp shed, and when the channel elements are moved in a second direction each channel element is moved into its corresponding part of the warp shed and the guide channel is closed, the total excursion of each channel element in one direction being at least equal to its length in the weft insertion direction, the channel elements having a cross-section which narrows in a direction away from an axis of the weaving rotor, the weft exit passage being located in a portion of each channel element furthest from said axis, said cross-section being triangular, one of the sides of the triangle being parallel to the radially inwardly arranged bottom surface of the channel element, and the weft exit passage being located at the radially outwardly arranged vertex of the triangle between the two side faces of the triangle and running parallel to the longitudinal axis of the channel elements.

7. The serial shed weaving machine according to claim 6, further comprising closing means for moving the two side faces of the channel elements together to close the weft exit passage.

8. The serial shed weaving machine according to claim 7, wherein the closing means comprises projections on the side faces of the channel elements, and backing pieces fixed to the weaving rotor and cooperating with the projections such that movement of the channel elements in the closing direction of the guide channel closes the weft exit passage.

9. The serial shed weaving machine according to claim 8, wherein each channel element has inclined portions on its forward and rearward end faces, the inclined portions forming an obtuse angle with respect to the weft insertion direction, the inclined portion of the forward end face having a tongue joined thereto, said tongue being inclined with respect to the weaving rotor in a segment adjoining said end face and having a dog at its free end.

10. The serial shed weaving machine according to claim 9, wherein warp threads in the lower shed position are guided along the inclined surface of the tongue to the adjoining end face of the channel element and through the gap to the radially outwardly arranged edge of the channel element when each channel element is moved out of its corresponding segment of the warp shed.

11. The serial shed weaving machine according to claim 9, further comprising two band-like elements which extend across the width of the warp and are arranged between a respective guide channel and the axis of the weaving rotor, said band-like elements driving the channel elements and having openings which engage the dogs of the tongues of the channel elements.

12. The serial shed weaving machine according to claim 11, wherein the band-like elements are disposed one above the other in the radial direction with respect to the weaving rotor, each of the band-like elements being attached at one end to the weft-insertion-side part of the weaving rotor by a spring, at least one of said band-like elements being attached to the drive means at the end opposite the spring connected end.

13. The serial shed weaving machine according to claim 12, wherein the means for moving the channel elements comprises an arm controlled by a cam, a pulley being rotatably mounted on said arm, and a cable passing around said pulley, one end of the cable being attached to one of the band-like elements and the other end of the cable being attached to the weaving rotor.

14. The serial shed weaving machine according to claim 13, wherein the cam is mounted in a housing which is rigidly attached to the machine frame, the arm being mounted on a piece which is connected to the weaving rotor in a rotationally fixed manner.

15. The serial shed weaving machine according to claim 11, wherein the weaving rotor is in the form of a hollow cylinder which extends across the width of the warp and which has first and second combs mounted in alternating fashion in the circumferential direction of the rotor, the first comb including set-up dents for the weft threads and the second comb including guide dents for the warp threads, the shed retaining means being mounted on the second comb, a channel or groove being associated with each of the dents of the second comb, said channel or groove running across the width of the warp parallel to the axis of the hollow cylinder on the surface of said cylinder, the backing pieces being mounted in the channel or groove.

16. The serial shed weaving machine according to claim 15, wherein each of the backing pieces includes an open jaw at their end furthest from the axis of the hollow cylinder, said jaw having side edges for engaging the projections on the channel elements, additional projections on the backing pieces which support the channel elements forming a radially inwardly arranged terminus of said jaw, and an opening adjoining the additional projections for accommodating and confining the band-like elements.

17. A serial shed weaving machine, comprising a weaving rotor having shed retaining means for disposing the warp threads in the form of traveling open warp sheds which travel in the warp direction, said weaving rotor having guide channels for guiding the weft threads transported by a flowing fluid through said open warp sheds, each of said guide channels including a plurality of axially elongated tubular channel elements, each of the channel elements having a weft exit passage therethrough and being movably mounted with respect to the other channel elements, each of the channel elements being configured at its forward and rearward ends with respect to the weft insertion direction such that when the channel elements of a respective guide channel are positioned for weft insertion the elements form a continuous closed guide channel, and means for moving the channel elements back and forth in the weft insertion direction such that when the channel elements are moved in a first direction the closed guide channel is opened to develop gaps between adjacent channel elements and each channel element is moved out of its corresponding part of the warp shed, and when the channel elements are moved in a second direction each channel element is moved into its corresponding part of the warp shed and the guide channel is closed, the total excursion of each channel element in one direction being at least equal to its length in the weft insertion direction, stop means on the weaving rotor for stopping the closing movement of each guide channel, and each guide channel being connected to means for producing a suction for weft thread insertion.

18. The serial shed weaving machine according to claim 17, wherein the stop means is disposed on the weft thread entry side of the weaving rotor, said first direction of motion of the channel elements being in the weft insertion direction, and said second direction of motion being in the direction opposite to the weft insertion direction.

* * * * *